United States Patent [19]

Feffer

[11] 4,293,985

[45] Oct. 13, 1981

[54] METHOD AND APPARATUS FOR MAKING BOUNCE CRIMPED YARN

[75] Inventor: Philip C. Feffer, Silver Springs, Md.

[73] Assignee: Chevron Research Company, San Francisco, Calif.

[21] Appl. No.: 110,050

[22] Filed: Jan. 7, 1980

[51] Int. Cl.[3] ..... D02G 1/16

[52] U.S. Cl. ..... 28/254; 28/258; 57/246

[58] Field of Search ..... 28/217, 220, 247, 254, 28/258; 57/246, 289, 350, 351, 908

[56] References Cited

U.S. PATENT DOCUMENTS

| | | | |
|---|---|---|---|
| 3,483,691 | 12/1969 | Williams et al. | 57/908 X |
| 3,665,567 | 5/1972 | Clarkson | 28/254 |
| 3,745,617 | 7/1973 | Smith | 28/220 X |
| 3,859,696 | 1/1975 | Guenther | 28/254 |
| 3,859,697 | 1/1975 | Guenther | 28/254 |
| 3,874,045 | 4/1975 | Butler et al. | 28/254 |
| 3,975,484 | 8/1976 | Okada et al. | 28/254 X |
| 4,226,010 | 10/1980 | Feffer | 28/254 X |

*Primary Examiner*—Donald Watkins

*Attorney, Agent, or Firm*—J. A. Buchanan, Jr.; T. G. DeJonghe; L. S. Squires

[57] ABSTRACT

Multi-filament thermoplastic bounce crimped yarns having improved fiber-fiber coherency and intermediate non-entangled yarns and methods and apparatus for making such yarns. The process is characterized by the use of a novel bounce crimper which produces a bounce crimped yarn substantially free of filament loops and filament entanglement which is then fluid vortex interlaced to produce a very fiber-fiber coherent yarn.

9 Claims, 5 Drawing Figures

METHOD AND APPARATUS FOR MAKING BOUNCE CRIMPED YARN

BACKGROUND OF THE INVENTION

1. Field of the Invention

This invention relates to an improved bounce crimp texturized multi-filament thermoplastic yarn and to methods and apparatus for making such yarns. In a further aspect this invention relates to a bounce crimp texturizing and fluid vortex interlacing process and apparatus for making bounce crimped yarn having improved fiber-fiber stability. In another aspect, the invention relates to a bounce crimped yarn substantially free from filament loops and entanglement and a modified bounce crimper for making yarn.

2. The Prior Art

Synthetic thermoplastic yarn materials are produced as a number of continuous, straight, smooth filaments. Such yarns have little bulk, and their utility in textile applications is thus rather limited.

In order to enhance the bulk and texture of synthetic yarns, a variety of crimping processes have been used in the past. One common technique which has been used for thermoplastic yarns is to bend the yarn filaments and heat the yarn while the filaments are in bent or crimped configurations, commonly referred to as false twist texturizing; note, for example, U.S. Pat. Nos. 3,932,986 and 3,946,546. Another type of texturizing is fluidized texturizing such as, for example, described in U.S. Pat. No. 2,869,976 and stuffer box crimping such as, for example, described in U.S. Pat. No. 4,081,886.

One especially good texturizing technique, in terms of yielding a high-bulked yarn, is known as "rebound" or "bounce crimping" such as for example described in U.S. Pat. No. 3,665,567.

Thermoplastic yarn texturized by the foregoing bounce crimping process possesses, inter alia, exceptional covering and as such is an especially desirable yarn. It should also be appreciated that bounce crimping yields a recognized type of texture, or crimp, different, for example, from that obtained by other forms of texturizing (e.g., stuffer box).

However, for certain application it would be desirable to increase the fiber stability, or fiber to fiber cohesiveness of this yarn.

Various methods of generally increasing yarn stability are known to the art including, the use of adhesives, twisters, and fluid interlacers such as, for example, described in U.S. Pat. Nos. 3,110,151; 3,116,588; 3,279,164 and 3,875,625. These interlacers operate by causing the yarn to pass through turbulent fluid vortexes causing the yarn to separate into groups of fibers which then interlace with each other forming a stable yarn. Different colored yarns have also been combined via texturizing, twisting and entangling such as shown in U.S. Pat. No. 3,460,336.

In attempting to improve the stability of bounce crimped yarn via fluid interlacing, I discovered that normal bounce crimped yarn could not be directly fluid interlaced effectively.

U.S. Pat. No. 3,703,753 discloses a process for texturizing and entangling thermoplastic yarn. Patentee teaches that after texturizing the yarn must be tensioned to remove a portion of the crimp prior to entangling and further teaches that where fluid texturizing is used it is preferable to use both a pretensioner and tensioner before entangling.

U.S. Pat. No. 3,975,484 discloses a process for drawing, fluid texturizing, and interlacing polyamide yarns, which requires the use of yarns having fiber having noncircular cross-sections and the use of nonaqueous oiling agent prior to drawing and a one-sided yarn heat treatment during drawing. More significantly, it is also apparent that the yarn is tensioned between texturizing and entangling when the yarn passes over the tensioning guide and through the take-up rolls.

SUMMARY OF THE INVENTION

I conjectured that the failure of normal bounce crimped yarn to fluid interlace may be due to the fact that yarn produced by normal bounce crimping has substantial fiber looping and fiber entanglement, which is generally considered desirable, because it provides fiber stability. However, I believe this filament looping and entanglement may prevent the filaments of the yarn from properly separating and interlacing in the fluid interlacing operation. This theory is also consistent with the prior art use of tensioners shown in U.S. Pat. No. 3,703,753 to partially remove crimp prior to interlacing since the filament loops and entanglement would also be removed by this operation. Thus, I conjectured that, if a bounce crimping operation could be developed which would produce a bounce crimped yarn which is substantially free from filament entanglement and filament loops, that this yarn could be effectively interlaced directly from the bounce crimper without the need for tensioners.

Accordingly, the present invention provides a bounce crimp texturizing method and apparatus for producing a bounce crimped yarn substantially free from loops and entanglement and for producing a bounce crimped yarn having improved fiber coherence.

In one embodiment the invention comprises an improved bounce crimped thermoplastic yarn (preferably polypropylene) substantially free from loops and having a fiber-fiber coherency index as measured by the weight-strain fiber coherency test of less than about 2 cm.

In a further embodiment the invention comprises an intermediate bounce crimped thermoplastic yarn (preferably polypropylene) product which is substantially free from fiber loops and entanglement and having a fiber-fiber coherency index as measured by the weight-strain fiber coherency test of at least 25 cm.

In another embodiment the invention comprises a yarn texturizing process comprising supplying a synthetic thermoplastic yarn to a fluidized bounce crimper and obstructing a portion of the fluid exhaust passage to yield a bounced crimped yarn substantially free of fiber loops and entanglement and in a further embodiment directing supplying said bounce crimped yarn from said bounce crimper to a fluidized yarn interlacer wherein the fibers of said yarn are interlaced thereby producing a very fiber-fiber coherent bounce crimped yarn.

In still another embodiment the invention provides a bounce crimper, for producing a bounce crimped yarn substantially free from fiber loops and fiber entanglement, comprising a housing defining a yarn crimping chamber and a generally vertical tubular yarn passage extending through said housing into said chamber, for supplying yarn to be texturized to said chamber, said chamber having an end opening aligned with the axis of said tubular passage and in the opposite wall thereto; a member having a foraminous surface covering said end opening, and aligned with the entrance of said tubular passage into said chamber, said chamber having a lateral yarn exit opening in a sidewall thereof for discharging bounce crimped yarn therethrough and means for introducing a heated fluid into said chamber wherein said fluid draws said yarn into said chamber and hurls said yarn against said foraminous surface, wherein said yarn is crimped and rebounded from said foraminous surface out through said yarn exit opening; and wherein at least a major portion of said fluid passes through said foraminous surface and out through said end opening, the improvement wherein said end opening is provided with an obstruction aligned with said yarn passage to obstruct the flow of said fluid through said end opening thereby substantially eliminating the formation of filament loops and filament entanglement in the bounce crimped yarn discharged from said bounce crimper.

The invention will be further described hereinbelow.

BRIEF DESCRIPTION OF THE DRAWING

A further understanding of the invention can be had from the following non-limiting drawings of preferred embodiments of the invention wherein like reference numbers refer to like parts.

FURTHER DESCRIPTION OF THE INVENTION AND PREFERRED EMBODIMENTS

The present invention is applicable to multi-filament thermoplastic yarns and deniers which can be bounce crimp texturized. Such thermoplastic yarns include, for example, nylon yarns, e.g., nylon 66, nylon 6, polyolefin yarns, e.g., polypropylene, combination yarns such as combinations of nylon and polypropylene; and the like. The invention can notably be applied to polypropylene, which is generally recognized to be one of the more difficult thermoplastic yarns to process. The drawn yarn fed to the texturizer typically has a denier in the range of about from 100 to 5000. The present invention can be applied to yarns having fibers having circular cross-sections as well as yarns having non-circular cross-sections (e.g. delta, y, etc.) It should also be noted that the terms "fibers" and "filaments" have been used interchangeably herein and refer to the individual filaments which comprise the yarn.

Figure 1:
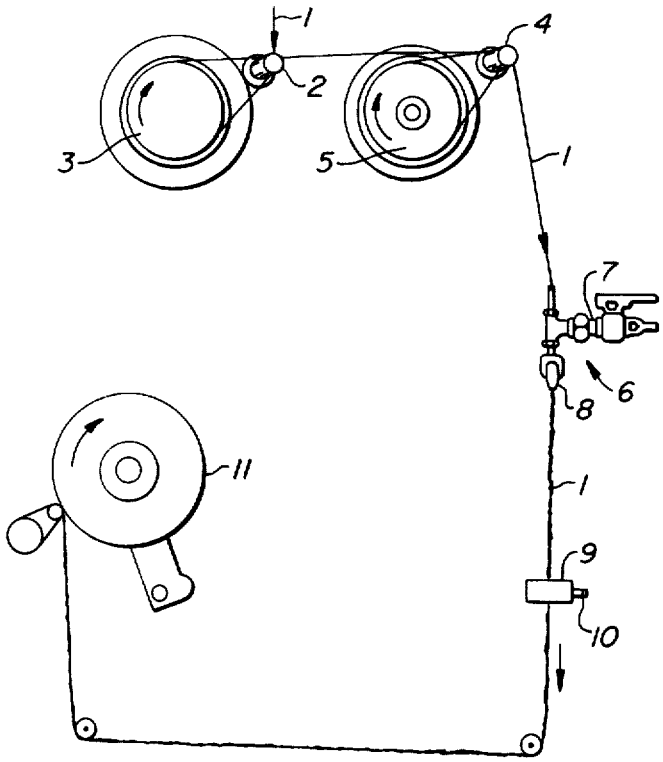
FIG. 1 is a schematic view of the process of the invention.

Referring now to FIG. 1 of the drawings, a preferred non-limiting embodiment of the invention will be described.

Undrawn thermoplastic yarn 1 (e.g., polypropylene, nylon 66, etc.) is fed from a supply package of yarn, not shown, to a first driven godet roller 3 with skewed separator roll 2 and then to a second driven godet roller 5 with skewed separator roll 4. Godet rolls 3 and 5 can be and typically are heated. Rolls 4 and 5 advance the yarns at a much greater speed than the rolls 2 and 3, thereby drawing the yarn. For example, using nylon 66, rolls 4 and 5 are typically operated at a peripheral speed in the range of about from 3 to 3.6 times that of rolls 2 and 3, thereby effecting about a 3 to 3.6 draw in the nylon 66 yarn. Using nylon 66, godet rolls 3 and 5 are typically operated at temperatures in the range of about from 275° F. to 325° F. Using polypropylene, rolls 4 and 5 are typically operated at peripheral speeds in the range of about 2.7 to 3.1 times that of rolls 2 and 3, thereby effecting about a 2.7 to 3.1 draw in the polypropylene yarn, and godet rolls 3 and 5 are typically operated at temperatures in the range of about from 222° F. to 275° F. Alternatively, pre-drawn yarn can be fed directly to bounce crimper 6.

The drawn yarn is generally fed to the texturizer at speeds in the range of about 1000 to 5000 fpm depending upon the denier of the yarn. Thus, where heavy denier yarns are used, slower speeds are preferably used (for example, with 1800 denier yarns it is preferred to operate at speeds around or below 1500 fpm) whereas fine denier yarns (for example, around 400 denier or less) can be used at speeds around 4000 to 5000 fpm or even higher. Optimum yarn speeds to maximize the production of the desired quality yarn can be determined by routine trial runs.

A compressible fluid such as steam or heated air is fed to the bounce crimper 6 through line 7. Generally, I prefer to use about 80–110 psig steam. In the bounce crimper, a jet of this fluid causes the yarn to be hurled against a foraminous surface (not shown) in the interior of the texturizing jet. From there, the yarn rebounds out through outlet tube 8 in a substantially tensionless state while the fluid passed through the foraminous surface and is discharged from the crimper. Yarn 1 leaves bounce crimper outlet tube 8 at a speed about 5 to 15% less than the feed speed due to the shortening of the yarn caused by crimping and loop-to-loop yarn compaction, and is ultimately collected on yarn package 16 at over-all average speeds of about 5–10% less than the feed speed due to the retained crimping (but substantial removal of the loop-to-loop yarn compaction).

Figure 2:
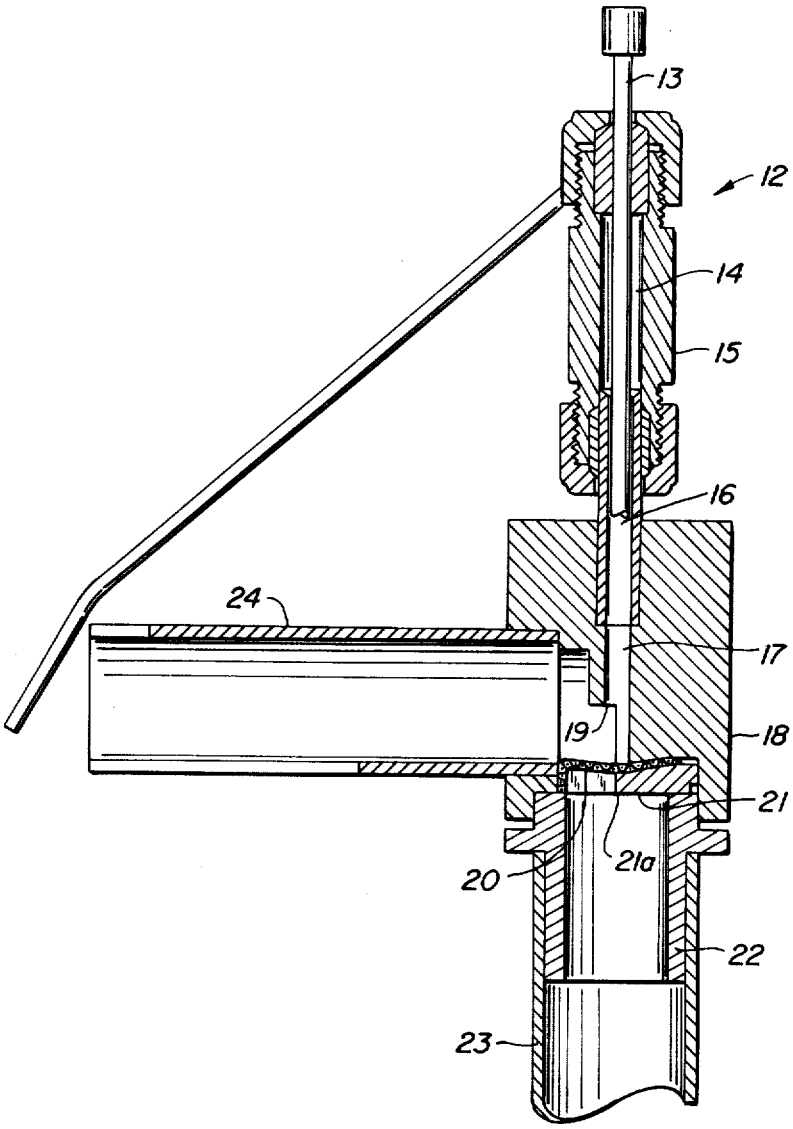
FIG. 2 is a side view section of the non-entanglement bounce crimper of the invention.

The key to the present invention is to provide a bounce crimped yarn product directly from the bounce crimper which is substantially free from filament loops and filament entanglement. I have found that the desired yarn product can be prepared without significant, if any, loss of crimp by obstructing a portion of the flow of fluid after it passes through the foraminous surface. (FIG. 2 illustrates a preferred bounce crimper of the invention, which affords such a product, and will be herein later described in detail.)

Continuing, the yarn is discharged from bounce crimper 6, under only very slight tension (generally about from 0 to 0.03 g/denier). It should also be appreciated, as before noted, that the yarn leaving the bounce crimper is generally compacted in the form of yarn loops (not filament loops) which generally fall out by the action of gravity or, if desired, by providing an intermediate bar to provide very slight tension, before the yarn is fed to fluid interlacer 9. In the interlacer groups of fibers are separated and interlaced by the action of fluid vortexes created within the interlacer via the action of the fluid supplied thereto via line 10 and the internal structural configuration of the interlacer. Such interlacers are well known to the art and are for example described in U.S. Pat. Nos. 3,110,151; 3,116,588; 3,279,164 and 3,875,625 and French Pat. No. 2,191,791. Any suitable compressible fluid can be used including for example air, nitrogen, low pressure steam.

Generally, I prefer to use air supplied to the interlacer at about ambient temperature.

The interlaced yarn can then be collected from the interlacer on any suitable collecting means such as driven package roll 11. Generally, the wind-up roll is driven at about the same speed or a slightly greater than the speed at which the yarn is discharged from the interlacer.

Figure 3:
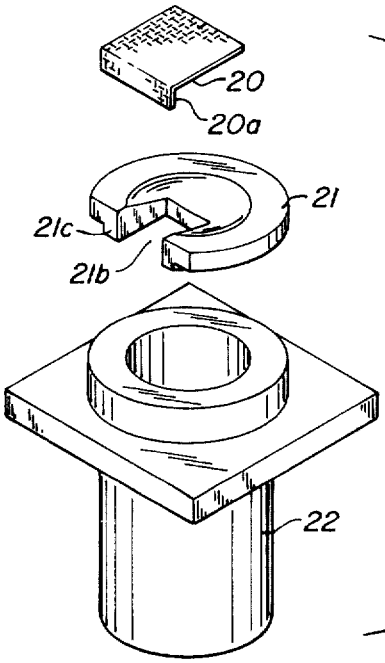
FIG. 3 is an exploded view of the foraminous surface, support platen and mounting collar illustrating the relationship of these elements and showing the platen aperture in detail.
Figure 4:
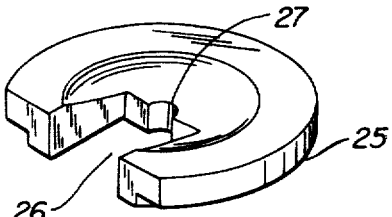
PRIOR ART FIG. 4.
FIG. 4 illustrates the prior art platen which would correspond to the platen shown in FIG. 3.

Referring now to FIGS. 2–4 the non-entangling bounce crimper of the invention will be described.

FIG. 2 shows a bounce crimper 12 which includes a yarn tube 13 which passes through a steam plenum chamber 14 formed by a plumbing tee 15. The plumbing tee 15 is connected through a steam valve 7 (FIG. 1) to a steam pipe so that steam may be fed to the plenum chamber 14 as regulated by valve 7.

The tube 13 passes completely through steam plenum chamber 14 and terminates within a yarn passage chamber 16. The yarn passage chamber 16 extends beneath the lower end of the tube 22 and is continued as a bore 17 in an adapter housing 18. The diameter of the bore 17 is the same as the internal diameter of the yarn chamber 16 so that a single diameter substantially cylindrical yarn passage is provided for the yarn as the yarn exits from tube 12 until it reaches a yarn exit opening 19 within the side of the adapter housing 18.

The external lower end of the adapter housing 18 has a convex configuration surrounding the lower end of the bore 17. A foraminous member 20, discussed in detail hereinafter, resting on platen 21 closes the lower end opening of the bore 16 to prevent the passage of yarn while simultaneously permitting fluid to longitudinally pass through the openings in the member 20 and discharge through the aperture in the platen.

The adapter housing 18 is fitted with a coaxial collar 22 which serves as an adapter for connection of the bore 17 with a steam exhaust conduit. By the provision of the exhaust conduit, fluid passing through foraminous member 20 may be drawn off by a blower (not shown).

The above-described texturizing station 12 serves to texturize or crimp thermoplastic yarn, introduced into tube 13 by the tenhnique of "rebound" or "bounce" crimping. In this connection, the thermoplastic yarn is heated as it advances through the yarn tube 13 and is picked up by the steam at the exit end thereof. The plastic yarn is then hurled longitudinally with great force by the downward flow of steam toward the foraminous member 20. The bulk of the steam passes through member 20, while the yarn rebounds or bounces from screen 20 instantaneously and in a continuously moving strand-like stream to flow upwardly and to the left into an outlet tube 24. From the outlet tube 24 the yarn is discharged from the bounce crimper.

Figure 2A:
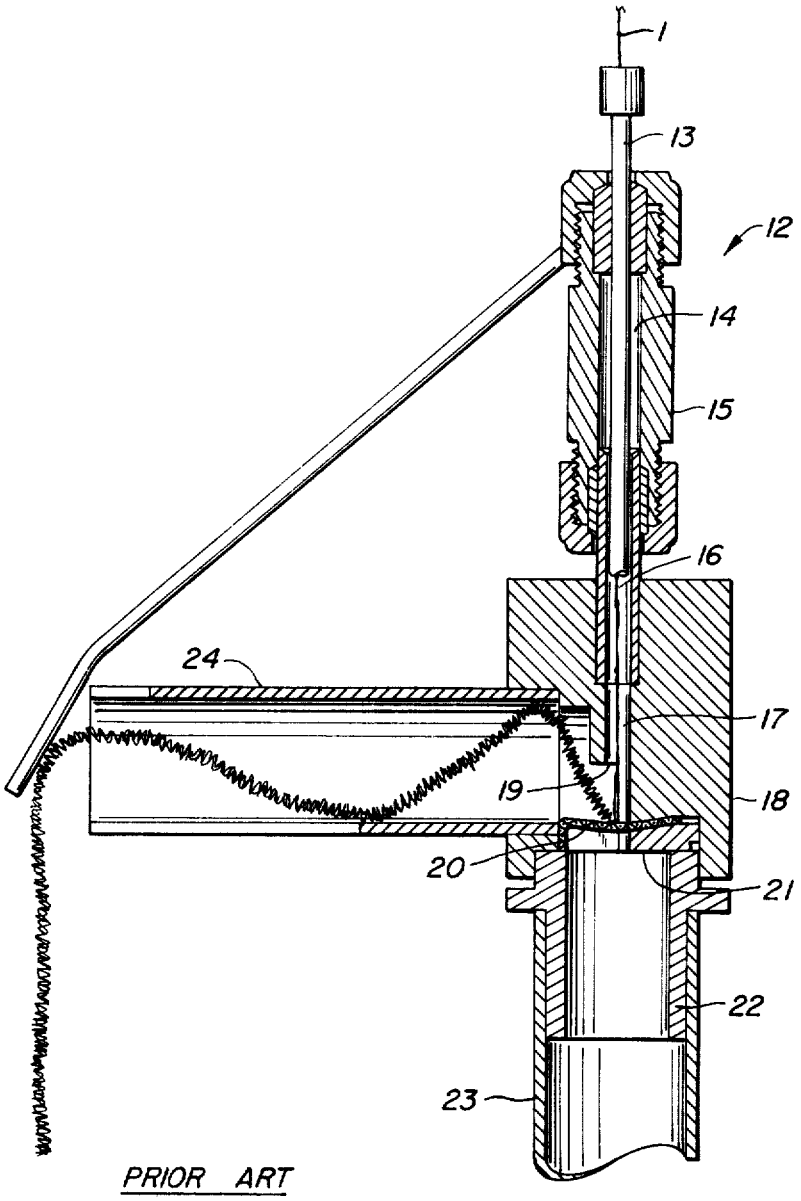
FIG. 2*a* is a side view section of the prior art bounce crimper corresponding to FIG. 2.

As can be seen from FIGS. 2 and 3, foraminous surface 20, provided with tab 20*a*, is supported at base of bore 17 by platen 21, provided with fluid exhaust aperture 21*b* and face 21*c*, which is in turn mounted in position by collar 22. Foraminous surface 20 completely covers aperture 21 and is oriented by tab 20*a* matching with platen face 21*c*. In contrast to the supporting means or platens of the prior art bounce crimpers, which provide a fluid exhaust aperture which is coextensive with yarn passage chamber 16–17, such, as for example, shown in FIG. 2*a*, the platen aperture in the present invention partially obstructs the extension of bore 17. Whereas, referring to FIG. 2*a*, it can be seen that in the prior art counterpart bounce crimper the platen aperture is coextensive with the yarn passage to form a continuous streamlined fluid exhaust passage.

The difference in the platen aperture is more clearly illustrated by FIGS. 3 and 4. Wherein FIG. 3 represents the present invention and FIG. 4 represents the prior art. Referring to FIG. 4 it can be seen that the platen 25 is provided with an exhaust aperture 26 having an arcuate portion 27—which has about the same radius as bore 17 so as to substantially match the base of bore 17 to form streamlined extension thereof for exhausting fluid therethrough. I have discovered that by the simple expedient of blocking off this arcuate portion of the prior art platen aperture, or more generally blocking off about from 40 to 60%, typically about 50%, of the cross-sectional area of the discharge extension of the yarn bore, that a bounce crimped yarn product, substantially free from filament loops and filament entanglements, can be obtained without any significant, if any, reduction in bounce crimp. The reason for this effect is not clearly understood.

It should be appreciated that various modifications of the bore restricting means could be used, for example, an adjustable weir means could be used for adjusting the amount of blockage of the bore passage or for example platen 21 could be combined with collar 22 as a single element.

Most conveniently, however, I prefer to use the platen means shown in FIGS. 2 and 3 because of its flexibility (i.e., bounce crimpers can be converted from normal operation to entanglement-free operation and vice versa merely by changing the platen) and uniformity (i.e. all of the crimpers in a given bank of crimper will have uniform fluid exhaust passages and should produce substantially equivalent yarns).

It should also be appreciated that the crux of this embodiment of the invention is the restricted fluid exhaust passage, preferably using the present platen having a fluid aperture which partially obstructs or blocks the extension of the yarn entrance passage bore. The particular construction of the crimper housing, screen, yarn outlet, etc. does not form part of the present invention. Thus, for purposes of illustration, the general bounce crimper disclosed in U.S. Pat. No. 3,859,697 has been shown in FIGS. 2–4 hereof. The present invention and the restricted aperture platen can be applied just as effectively to any enclosed chambered bounce crimper including, for example, those disclosed in U.S. Pat. Nos. 3,665,567; 3,859,696; 3,887,971 and 4,163,306.

The bounce crimped interlaced thermoplastic yarn of the present invention is substantially loop-free and is characterized by superior yarn stability as evidenced by a fiber-fiber coherency index of about 2 cm or less (for example about from 2 to 0.1 cm and preferably 1.5 cm or less) as measured by the weight-strain fiber coherency test. The polypropylene yarns of the invention are especially preferred.

What is claimed is:

1. A process for manufacturing a bounce crimped multifilament thermoplastic yarn having improved fiber-fiber coherency which comprises the steps of:

(a) supplying a drawn multi-filament thermoplastic yarn to an enclosed texturizer chambered bounce crimper comprising a texturizing chamber, a yarn entrance passage, a lateral yarn exit passage, a fluid inlet passage, a fluid exhaust passage axially aligned with said yarn entrance passage and a foraminous surface covering said fluid exhaust passage, and supplying a compressible heated fluid to said texturizing chamber with sufficient force to draw said yarn into said texturizing chamber and hurl it against said foraminous surface with sufficient force to axially compress said yarn and rebound and discharge said yarn from said bounce crimper through said yarn exit and whereby the bulk of said fluid passes through said foraminous surface and said fluid exhaust passage;

(b) obstructing a portion of said fluid exhaust passage to substantially prevent the occurrence of filament loops and filament entanglement in said discharged crimped yarn; and (c) supplying the discharged crimp yarn to a fluid vortex interlacer, without substantially increasing the tension on said crimped yarn, wherein said crimped yarn is fluid interlaced to yield a bounced crimped yarn having improved fiber-fiber coherency.

2. The process of claim 1 wherein said fluid used in step (a) is saturated 80–110 psig steam and wherein air at about ambient temperature is supplied as the fluid to said interlacer.

3. The process of claim 1 wherein said yarn has a denier of about 400 or less and is supplied to said bounce crimper in step (a) at a speed of at least about 4000 fpm.

4. The process of claims 1, 2 or 3 wherein said thermoplastic yarn is polypropylene.

5. A process for making a substantially entanglement-free and loop-free thermoplastic multi-filament bounce crimped yarn which comprises the steps of (a) supplying a drawn multi-filament thermoplastic yarn to an enclosed texturizer chambered bounce crimper comprising a texturizing chamber, a yarn entrance passage, a lateral yarn exit passage, a fluid inlet passage, a fluid exhaust passage axially aligned with said yarn entrance passage and a foraminous surface covering said fluid exhaust passage, and supplying a compressible heated fluid to said texturizing chamber with sufficient force to draw said yarn into said texturizing chamber and hurl it against said foraminous surface with sufficient force to axially compress said yarn and rebound and discharge said yarn from said bounce crimper through said yarn exit and whereby the bulk of said fluid passes through said foraminous surface and said fluid exhaust passage;

(b) obstructing a portion of said fluid exhaust passage to substantially prevent the occurrence of filament loops and filament entanglement in said discharged crimped yarn; and (c) collecting said bounce crimped yarn.

6. A bounce crimping apparatus, for making bounce crimped yarn substantially free from filament loops and entanglement, comprising in operative relationship a housing defining a yarn crimping chamber; a generally tubular yarn passage for supplying yarn to said crimping chamber; a means for supplying fluid to said crimping chamber; a lateral yarn exit passage for discharging crimped yarn from said crimping chamber; a fluid exhaust opening in said housing for discharging fluid from said chamber and wherein said fluid exhaust opening is generally axially aligned with the axis of said tubular yarn passage and in an opposite wall thereto; a foraminous surface positioned across and covering said fluid exhaust opening for preventing the passage of yarn while permitting the passage of fluid therethrough; an exhaust fluid restricting means for obstructing a portion of the said fluid exhaust opening thereby preventing the substantial formation of filament loops and entanglement in said yarn whereby yarn supplied to said texturizing chamber is hurled against said foraminous surface by said fluid, thereby crimping said yarn and rebounding it from said crimper through said lateral yarn exit passage.

7. The bounce crimping apparatus of claim 6 wherein a side wall of said crimping chamber forms a substantially streamlined continuation of a side wall of said tubular yarn passage and terminates in said fluid exhaust opening and wherein said restricting means is positioned beneath said foraminous surface in approximate contact therewith and obstructs a portion of said exhaust end opening extending from said side wall equal to about from 40 to 60% of the cross-sectional area of said tubular yarn passage at its entrance into said crimping chamber.

8. The bounce crimping apparatus of claim 7 wherein said restricing means obstructs an amount of said fluid exhaust passage equal to about 50% of the cross-sectional area of said tubular yarn passage.

9. The bounce crimping apparatus of claim 7 wherein said foraminous surface is supported on a platen means provided with a fluid passage aperture means for permitting the exit of fluid passing through said foraminous surface and wherein said fluid passage aperture means is provided with said restricting means.

* * * * *